US010104929B2

(12) United States Patent
Schrader et al.

(10) Patent No.: US 10,104,929 B2
(45) Date of Patent: Oct. 23, 2018

(54) HELMET WITH EXTERNALLY POSITIONABLE INTERNAL EAR CUPS

(71) Applicant: Light Speed Aviation, Inc., Lake Oswego, OR (US)

(72) Inventors: Allan Schrader, Lake Oswego, OR (US); Matthew Raymond Evonuk, Tualatin, OR (US)

(73) Assignee: Light Speed Aviation, Inc., Lake Oswego, OR (US)

( * ) Notice: Subject to any disclaimer, the term of this patent is extended or adjusted under 35 U.S.C. 154(b) by 370 days.

(21) Appl. No.: 14/874,878

(22) Filed: Oct. 5, 2015

(65) Prior Publication Data

US 2016/0095376 A1 Apr. 7, 2016

Related U.S. Application Data

(60) Provisional application No. 62/061,102, filed on Oct. 7, 2014.

(51) Int. Cl.
*A42B 3/16* (2006.01)

(52) U.S. Cl.
CPC ..... *A42B 3/166* (2013.01)

(58) Field of Classification Search
CPC ..... A42B 3/166
USPC ..... 2/410, 423
See application file for complete search history.

(56) References Cited

U.S. PATENT DOCUMENTS

| | | | | | |
|---|---|---|---|---|---|
| 3,091,771 | A * | 6/1963 | Bixby | A42B 3/166 | 2/423 |
| 3,178,723 | A * | 4/1965 | Aileo | A42B 3/166 | 2/209 |
| 3,400,406 | A | 9/1968 | Aileo | | |
| 3,470,564 | A | 10/1969 | Aileo | | |
| 3,535,710 | A | 10/1970 | Aileo | | |
| 3,918,098 | A * | 11/1975 | Devaney | A42B 3/166 | 2/209 |
| 4,453,277 | A * | 6/1984 | Durand | A42B 3/14 | 2/416 |
| 6,154,890 | A | 12/2000 | Deopuria et al. | | |
| 6,754,911 | B1 | 6/2004 | Howell | | |
| 2012/0102629 | A1 | 5/2012 | Lott et al. | | |

* cited by examiner

*Primary Examiner* — Katherine Moran
(74) *Attorney, Agent, or Firm* — Brooks Kushman P.C.

(57) ABSTRACT

A helmet includes a shell configured to extend over ears of a user with integrated acoustic ear cups or ear phones that can be positioned and pressure adjusted while the helmet is in use. An adjustment mechanism connected to each ear cup includes a portion extending through an aperture in the helmet shell to facilitate movement of the ear cup using the portion extending through the shell. The adjustment mechanism may be used to move the ear cups between a retracted position to facilitate donning and removal of the helmet and a user adjustable deployed position with user adjustable side pressure to facilitate sealing and comfort for passive or active noise reduction (ANR).

6 Claims, 5 Drawing Sheets

HELMET WITH EXTERNALLY POSITIONABLE INTERNAL EAR CUPS

CROSS-REFERENCE TO RELATED APPLICATION

This application claims the benefit of U.S. provisional application Ser. No. 62/061,102 filed Oct. 7, 2014, the disclosure of which is hereby incorporated in its entirety by reference herein.

TECHNICAL FIELD

This application relates to a helmet having internal ear cups, headphones, or similar devices and a positioning mechanism that can be manipulated externally to position the devices while the helmet is in use.

BACKGROUND

Helmets are worn to protect the head of the user from injuries that may occur in a wide variety of recreational, occupational, transportation, and military applications. The helmet design may vary depending on the type and frequency of expected impacts. Similarly, use patterns may vary from repeated removal of the helmet between short duration uses, such as those that may occur in football or hockey, to extended periods of use, such as those that may occur in occupational, transportation, or military applications, for example. In many applications, the helmet may extend partially or completely over the ears of the user. The helmet may be designed to reduce transmission of external sound, or to minimally impact transmission of external sound to the wearer. Active audio devices such as speakers and microphones and/or passive devices such as acoustic sound absorbing material may be used alone or in combination to provide the desired helmet acoustics.

In passive and active noise reduction helmet applications, performance and wear-ability may be improved by providing a complete seal around or within the ears without compromising comfort over long use durations. Current helmet designs appear to lack the ability to achieve these seal and comfort goals without significant tradeoffs between them.

A variety of non-military helmets and others that do not include fully customized shells provide adjustable ear cups. However, the ear cup assembly is mounted and positioned within the helmet using a repositionable or removable fastener, such as a hook and loop closure. The external shell is a hard molded shape with the ear cup assembly moveable within the inner lining of the shell. Foam pads and strips of hook and loop closure material is used to provide a customized fit for each user. These types of positioning systems require that the helmet be removed to position the ear cup assembly and comfortable positioning often requires several trial and error attempts by the user. These systems are also generally fixed or static once positioned within the helmet, although repeatedly wearing and removing the helmet may disturb the positioning of the ear cups. In addition, side pressure is established by the external shell dimension and the selection or combination of padding positioned through this iterative process. These systems are generally not amenable to additional adjustments during use with respect to position or pressure and may experience reduced performance with respect to comfort and seal over a particular period of use.

Helmets having active noise reduction (ANR) technology to cancel at least some of the unwanted external noise rely on a good seal around or in each ear to achieve best results. A good seal is particularly difficult to achieve inside a helmet for at least two reasons: helmets generally fit fairly tightly to provide their protective function, and the ear pinna protrudes from the surrounding surfaces of the head and varies in shapes and sizes among users. As such, putting the helmet on and proper positioning of previously placed ear cups or earphones can be very challenging. After the helmet is placed on the head, the seal around the ear may not be ideal based on ear position (within the ear cup) or the ear cup position relative to the skull. To achieve desired acoustic performance, users may over-compensate for acoustic leak paths by increasing the side pressure, which may result in reduced comfort particularly over long periods of time.

For best performance of an ANR system, the positioning of the ear canal and pinna relative to the driver/speaker and ANR feedback microphone within the ear cup or earphones should be understood and repeatable. Current solutions generally fail to deliver consistent performance with either the acoustics or the cushion/seal system. Available helmet shell-based solutions also generally do not offer customized left cup and right cup acoustic systems that are used by the best performing non-helmet based ANR headsets. Largely due to positioning and comfort constraints previously described, existing helmets use a full round/oval seal that does not leverage various advantages associated with a "slot seal" design that allows the pinna to extend into a slot between the cushion and other components of the ear cup, which may provide a better seal for a given amount of side pressure. This is likely because of the difficulty in positioning the pinna into the ear slot seal when donning the helmet due to the fixed ear cup within the helmet.

SUMMARY

In one or more embodiments, a helmet includes a shell configured to extend over ears of a user and having an aperture, an ear cup disposed within the shell, and an adjustment mechanism connected to the ear cup, the adjustment mechanism having a base fixed to an interior of the shell and a portion extending through the aperture of the shell to facilitate movement of the ear cup using the portion extending through the shell while the helmet is worn by a user. The helmet of claim 1 wherein the aperture comprises an elongated slot and wherein the portion extending through the shell slides within the elongated slot to position the ear cup. The portion extending through the shell may be adapted to selectively clamp against the shell to releaseably secure the adjustment mechanism to the shell. The adjustment mechanism may be configured to move the ear cup between retracted and deployed positions toward and away from the shell, respectively, using the portion extending through the shell, which may also be used to adjust side pressure of the ear cup during use of the helmet.

In one embodiment, a helmet having a shell configured to receive and substantially surround integrated circumaural ear cups includes an externally operable adjustment mechanism for each ear cup. The adjustment mechanisms may include a portion adapted to couple to an associated ear cup and a portion extending through the shell to move the associated ear cup between a retracted position and an engaged position using the portion extending through the shell. The adjustment mechanism may also be used to vary distance between an associated ear cup and the shell to adjust side pressure of the ear cups experienced by the user during use of the helmet. Ear cup side pressure may be adjusted independently of other contact points associated with overall helmet shell fit.

Various embodiments may include a helmet having an adjustment mechanism configured to simultaneously move the ear cup inward and forward during deployment, and simultaneously move the cup outward and rearward during retraction using the portion extending through the shell during use of the helmet. In one embodiment, the helmet comprises an elongated slot with the adjustment mechanism configured to move the ear cup inward as the portion extending through the shell moves forward within the elongated slot. The adjustment mechanism may include or cooperate with a base having an inward facing surface curved to guide movement of the ear cup along a predetermined trajectory as the portion extending through the shell moves within the elongated slot.

In one embodiment, the portion of the adjustment mechanism extending through the shell comprises a pair of nested threaded posts including a first post coupled to the ear cup to adjust distance between the ear cup and the shell to adjust side pressure. A second post cooperates with a locking nut inside the shell to selectively clamp the adjustment mechanism to the shell.

Various embodiments may include an adjustment mechanism having a positioning member with first and second arms joined at a rearward end and spaced apart at a forward end, the forward end of each arm including an aperture configured to receive a mounting post connected to the ear cup. The first and second arms may be biased away from one another using a spring. Alternatively the positioning member may be formed of a resilient material, such as plastic or spring steel, for example. The adjustment mechanism may also include an arch secured to the base and having an opening configured to limit distance between the forward ends of the first and second arms as the positioning member moves through the arch.

In one embodiment, the helmet includes an ear cup having a circumaural housing with an exterior portion coupled to the adjustment mechanism and an interior divider. A cushion is secured to the housing and spaced from the interior divider to create a slot configured to receive a pinna of a user as the ear cup moves from a rearward retracted position to a forward deployed position within the helmet shell.

Embodiments according to the present disclosure may have one or more associated advantages. For example, a helmet having integrated ear cups associated with an adjustment mechanism that is externally operable facilities in-use adjustments to improve ear cup seal and comfort while being worn by the user. Embodiments according to the present disclosure may be used to improve passive and active acoustic performance in a wide variety of applications including sports such as football and auto racing, in transportation such as military and non-military aviation, motorcycles, etc. and any occupations that utilize protective headgear having acoustic performance specifications. Embodiments of helmets having a positioning mechanism that both positions the ear cup assembly personally and also allows for in-use side pressure adjustments may result in improved comfort and acoustic performance in long-duration use applications.

In addition to ear seal and comfort benefits, various embodiments include a positioning or adjustment mechanism that is externally operable to retract and deploy the ear cups to facilitate donning and doffing the helmet. Positioning of the ear cups after donning the helmet reduces or eliminates repeated trial and error commonly associated with temporary permanent systems that use hook and closure fasteners where the helmet must be removed for adjustments. Movement trajectory or profile of the ear cups between retracted and deployed positions can be controlled to facilitate placement of the user's pinna within a gap or slot formed between the ear cup cushion and an internal ear cup divider.

The above advantages and other advantages and features will be readily apparent from the following detailed description when taken in connection with the accompanying drawings.

DETAILED DESCRIPTION

As required, detailed embodiments are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the teachings and representative embodiments of the disclosure.

For ease of description and illustration, this disclosure may use terms of relative motion that are intended to be interpreted broadly with respect to a helmet as normally worn on the head of a user. Alternatively, movement may be described along x, y, and z axes assigned according to an industry standard, such as SAE J211, for example. As such, terms such as inward and outward refer to movement toward or away from the head of the user, respectively, or along the y-axis. Similarly, inward and outward movements may be interpreted as movement within the helmet away from the helmet shell and toward the helmet shell, respectively. Other directional terms such as forward or rearward, or movement along the x-axis, may be used to describe directions toward the front or rear of the head of a user wearing the helmet. In a similar manner, upward and downward movements refer to movements along the z-axis toward the crown or chin, respectively.

Figure 1:
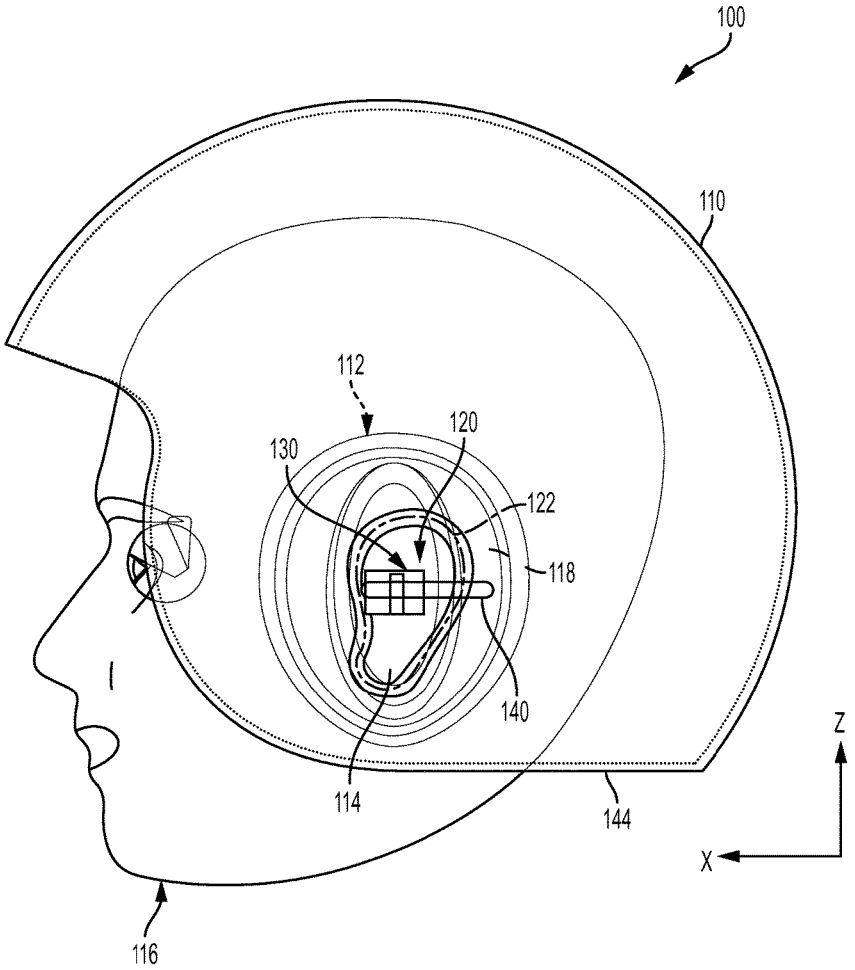
FIG. 1 is a side view of a helmet having integrated ear cups with an externally operable adjustment or positioning mechanism according to various embodiments.
Figure 2:
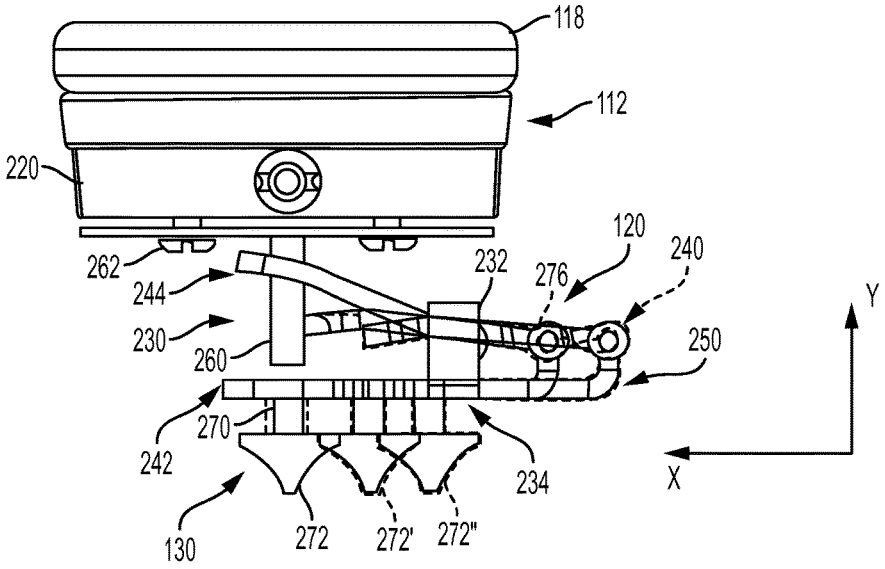
FIG. 2 is a top view of a representative embodiment of an adjustment mechanism for positioning ear cups within a helmet during use.

Referring now to FIGS. 1 and 2, FIG. 1 is a side view of a helmet having integrated ear cups with an externally operable adjustment or positioning mechanism according to various embodiments. FIG. 2 is a top view of a representative embodiment of an adjustment mechanism for positioning ear cups within a helmet during use.

Helmet 100 includes a shell 110 configured to receive and substantially surround integrated circumaural ear cups 112, only one of which is illustrated in the Figures. Typical applications include an ear cup 112 for each of the ears 114 of a user 116. Each of the ear cups 112 may be substantially identical for left and right ears, or may be customized with different ear cups for the right and left ears 114. Similarly, ear cups 112 may be customized for a particular user with the left and right ear cups for that user being the substantially identical. In some embodiments, the left and right ear cups 112 may include different components for passive and/or active noise reduction or audio. For example, in passive noise reduction applications, only one of the ear cups 112 may include a speaker to provide mono audio. Typical active noise reduction (ANR) applications include a driver/speaker and at least one noise-sensing microphone positioned within each of the ear cups 112 to provide active noise reduction and stereo audio for user 116. Helmet 100 may also include an integrated communication microphone (not shown), such as a boom microphone, to capture voice input from user 116.

As those of ordinary skill in the art will appreciate, although the representative embodiments include circumaural ear cups 112, the teachings of the present disclosure may be equally applied or adapted to other types of acoustic headphones or earphones including supra-aural headphones and in-the-ear type headphones, earphones, earbuds, etc. although other types of headphones and earphones may not achieve various advantages associated with improved sealing and comfort.

As also shown in FIG. 1, helmet 100 includes an adjustment mechanism 120 associated with each of the ear cups 112 having a portion 230 (FIG. 2) adapted to couple to an associated ear cup and a portion 130 extending through an elongated slot 140 in the shell 110 to move the associated ear cup 114 between a retracted position and an engaged position (best illustrated in FIGS. 3 and 4) using portion 130 extending through shell 110. Elongated slot 140 may be positioned at an angle relative to a bottom edge 144 of helmet 100, or alternatively relative to the x-axis to provide movement of ear cups 112. As described in greater detail with reference to FIGS. 2-5, portion 130 extending through shell 110 may be used to selectively clamp against the shell to secure the adjustment mechanism 120 at a desired position within elongated slot 140 of shell 110. In addition, external portion 130 of adjustment mechanism 120 may be used to control distance between the associated ear cup 112 and the interior of shell 110 to increase or decreasing resulting side pressure of the ear cup experienced by user 116 during helmet use.

As illustrated in FIG. 1, helmet 100 includes a shell 110 configured to cover ears 114 of user 116. In various embodiments, helmet shell 110 substantially or entirely covers ear cups 112 when viewed from the side or along the y-axis. While the front portions of ear cups 112 may be visible from the front and bottom of helmet shell 110, each of the ear cups 112 is contained substantially within shell 110. As described in greater detail with reference to FIGS. 2-5, ear cups 112 are integrated within shell 110 and may be externally positioned using adjustment member 120 while helmet 100 is in use or worn by user 116.

In one embodiment, ear cups 112 each include a cushion 118. Adjustment mechanism 120 facilitates positioning of ear cups 112 after user 116 dons helmet 100. Position of ear cups 112 while helmet 100 is worn by user 116 facilitates alignment of each pinna 122 of an associated ear 114 with an associated slot or gap between cushion 118 and ear cup housing 220 (FIG. 2) as ear cups 112 are moved between a retracted position (FIG. 3) and deployed or engaged position (FIG. 4).

As shown in the top view of FIG. 2, a representative embodiment of an adjustment mechanism 120 facilitates positioning of ear cups 112 within helmet 100 during use. Adjustment mechanism 120 includes an arch 232 is adapted to be fixedly secured to an interior portion of shell 110 (FIG. 1). In the embodiment illustrated, arch 232 is implemented by a generally three-sided or four-sided rectangular or a curved or arcuate component having a bottom side or the bottom portion 234 adapted to be secured within an interior portion of the helmet shell. Bridge or arch 232 includes an opening adapted or configured to receive positioning component or positioner 240.

Positioner 240 includes a first arm 242 and a second arm 244 connected at a proximate end 250 and spaced apart from one another at a distal end. Each arm 242, 244 includes an aperture adapted to receive an ear cup mounting post 260. Ear cup housing 220 is secured to ear cup mounting post 260 using fasteners 262. Alternatively, post 260 may be secured to housing 220 using an adhesive, or may be integrally formed with housing 220, for example. Mounting post 260 may include internal and/or external threads to cooperate with a threaded stud 270 associated with portion 130 to adjust distance between ear cups 112 and the helmet shell, resulting in varying side pressure of the ear cups 112 for the user. Threaded stud 270 may be coupled to or integrated with a handle or knob 272 to facilitate movement of positioner within the opening of arch 232 as guided by elongated slot 140 (FIG. 1). Similarly, knob 272 may be used to adjust distance between the interior of the helmet shell and ear cups 112 by engaging complementary threads between post 260 and stud 270. Side pressure may be adjusted during use of the helmet to facilitate improved sealing between the user's head and cushion 118 of ear cup 112, as well as to improve user comfort.

Arms 242 and 244 of positioner 240 may be resiliently biased relative to one another. In one embodiment, a spring (not shown) is operatively associated with arms 242, 244 to resiliently bias arms 242, 244 away from each other. The spring may be a linear spring positioned between arms 242, 244 or a coil spring associated with a hinge 274 connecting first arm 242 to second arm 244. Alternatively, arms 242, 244 may be formed of a resilient material, such as a plastic or spring steel to bias arms 242, 244 away from one another. In one embodiment, a single arm 244 is resiliently biased away from an interior portion of shell 110.

In one embodiment, adjustment mechanism 120 may include a clamping device operatively associated with positioner 240 and having a portion 130 extending through the elongated slot 140 of shell 110 to move positioner 240 within the opening of arch 232 and to selectively secure positioner 240 in a user selected position along the elongated slot 140 of shell 110. FIG. 2 illustrates three representative positions in broken lines representing positioner 240 as it moves within the opening of arch 232 including a retracted position, and two deployed/engaged positions. While three representative positions are shown, adjustment mechanism 120 is generally continually adjustable along the length of elongated slot 140.

As generally illustrated in FIGS. 1 and 2, the user can operate adjustment mechanism 120 using external knob 272 to position ear cup 112 for a selected or desired seal and comfort while wearing helmet 100. As positioner 240 moves within the opening of a lateral positioning component, implemented by arch 232 in the representative embodiment illustrated, arch 232 forces second arm 244 toward first arm 242 to provide lateral movement of ear cup 112. Second arm 244 may include one or more portions angled relative to one another to facilitate movement within arch 232 and/or to provide a desired movement trajectory or profile of ear cup 112 between retracted and engaged positions.

Figure 3:
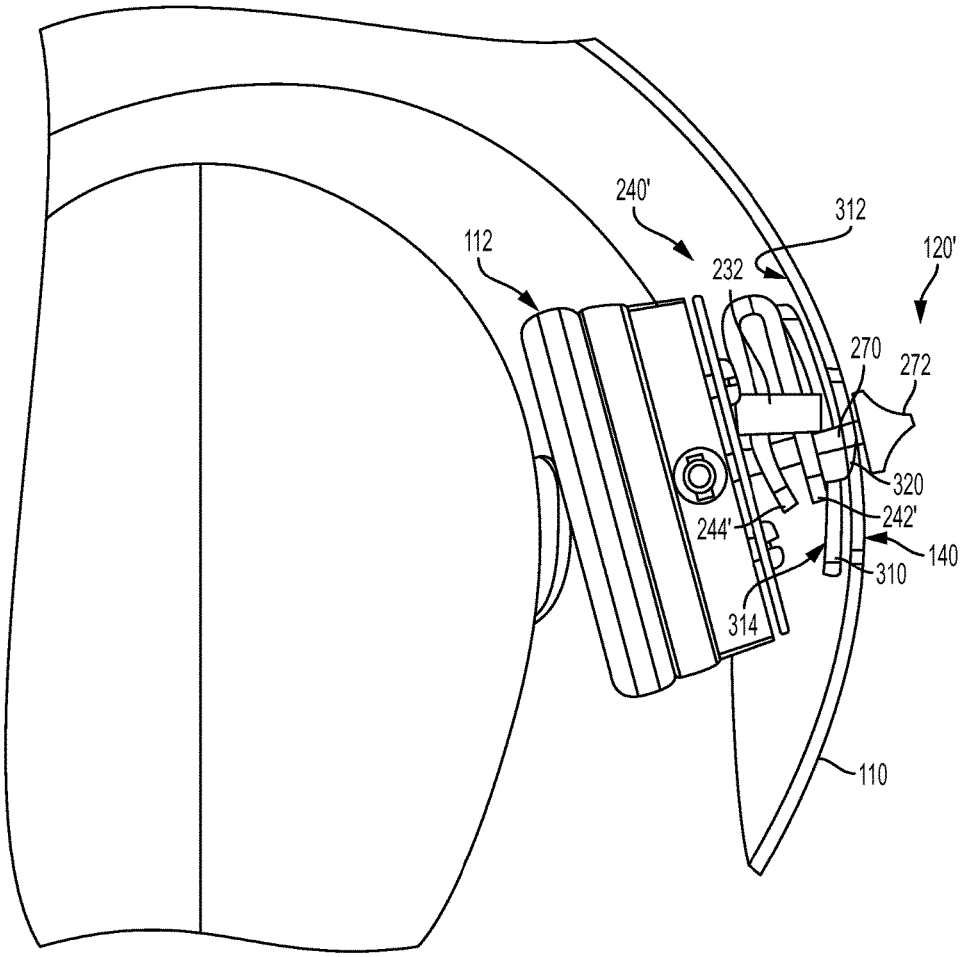
FIG. 3 is a partial cut-away top view of a representative embodiment of a helmet having an externally operable ear cup adjustment or positioning mechanism with the ear cup in a retracted position.
Figure 4:
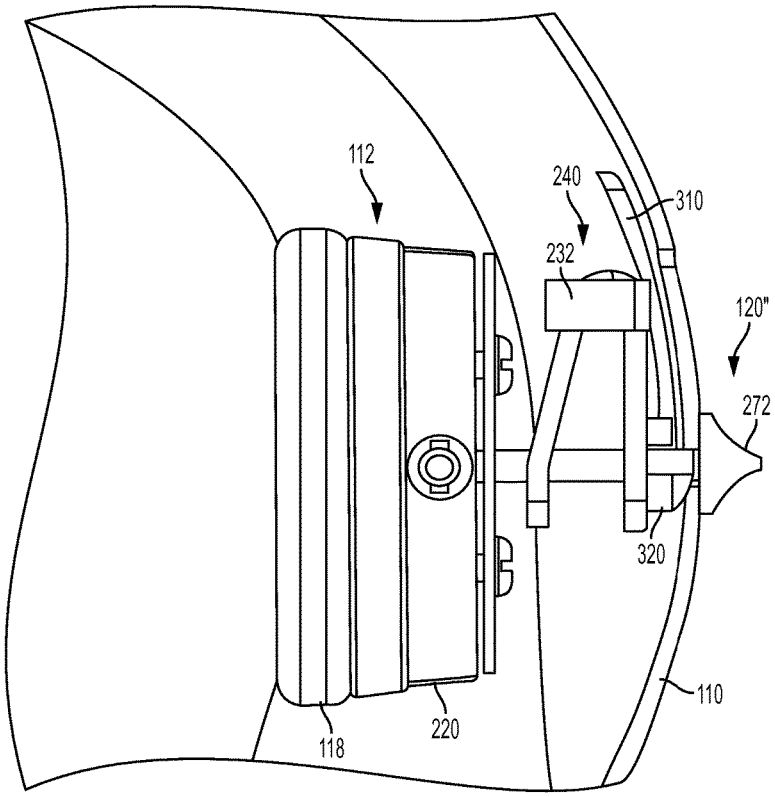
FIG. 4 is a partial cut-away top view of a representative embodiment of a helmet having an externally operable ear cup adjustment or positioning mechanism with the ear cup in a deployed or engaged position.

Referring now to FIGS. 3 and 4, FIG. 3 is a partial cut-away top view of a representative embodiment of a helmet having an externally operable ear cup adjustment or positioning mechanism with the ear cup in a retracted position, and FIG. 4 is a partial cut-away top view of a representative embodiment of a helmet having an externally operable ear cup adjustment or positioning mechanism with the ear cup in a deployed or engaged position. The embodiments illustrated in FIGS. 3 and 4 include components similar or identical to the previously described embodiments with some alternative features incorporated as illustrated and described. Primed reference numerals are used to denote features that provide similar functions as previously described, but that may have an alternative implementation or details relative to the previously described feature or component. In the embodiments of FIGS. 3 and 4, alternative implementations of an adjustment mechanism 120' and 120" are illustrated.

As generally illustrated in FIG. 3, adjustment mechanism 120' includes a base 310 fixed to an interior portion 312 of shell 110 and having a surface profile 314 configured to guide the positioner 240' along a desired trajectory or profile as positioner 240' and portion 270 moves within the elongated slot of shell 110. Positioner 240' includes arms 242', 244' formed of a single, unitary U-shaped component rather than a hinged component. Positioner 240' may be formed of a resilient material, or may cooperate with one or more springs to provide a biasing force between arms 242' and 244'. In the embodiments illustrated in FIGS. 3 and 4, a clamping device is implemented by a threaded stud 270 extending through the elongated slot and having a knob 272 secured thereto. Knob 272 has a diameter larger than a width of the elongated slot. A threaded receiver 320 is secured to positioner 240' and configured to cooperate with the threaded stud 270 and knob 272 to selectively secure the positioner 240' along the elongated slot of the shell by clamping shell 110 between knob 272 and receiver 320. In various embodiments, receiver 320 is implemented by a nut or integrated into a threaded hole of positioner 240', for example.

The embodiment of FIG. 4 includes an adjustment mechanism 120" that includes a positioner 240 in combination with base 310 and a clamping mechanism implemented by knob 272 having a threaded stud to engage complementary threads of receiver 320 as previously described. In one embodiment, the portion of the adjustment mechanism 120" and/or clamping device implemented by knob 272 and receiver 320 includes a pair of nested threaded posts including a first post coupled to the ear cup 112 to adjust distance between the ear cup 112 and the interior 312 of shell 110 to adjust side pressure. A second post cooperates with receiver 320 or a locking nut to selectively clamp the adjustment mechanism 120" to shell 110 as previously described.

As generally illustrated in FIGS. 3 and 4, adjustment mechanisms 120', 120" may be externally operated by user 116 while the helmet is in use or worn on the head of the user. The adjustment mechanisms 120', 120" are configured to simultaneously move the ear cup 112 inward and forward between a retracted position illustrated in FIG. 3, and a deployed or engaged position illustrated in FIG. 4. Prior to removing the helmet, the adjustment mechanisms 120', 120" may be externally operated to simultaneously move the ear cup 112 outward and rearward using the portion extending through the shell during use of the helmet.

Figure 5:
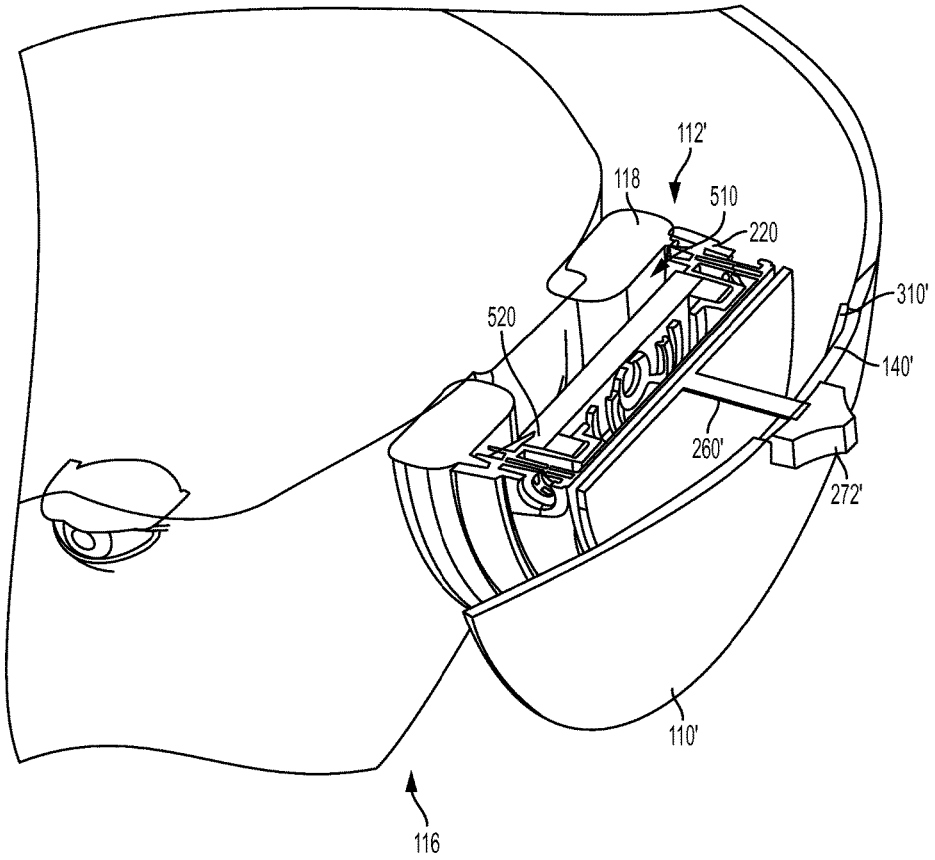
FIG. 5 is a partial cross-section of a representative embodiment of a helmet having an integrated ear cup with a cushion secured to an ear cup housing to form a slot or gap configured to receive the pinna of a user.

FIG. 5 is a partial cross-section of a representative embodiment of a helmet having an integrated ear cup with a cushion secured to an ear cup housing to form a slot or gap configured to receive the pinna of a user. The embodiment illustrated in FIG. 5 is similar to the previously described embodiments. As shown in FIG. 5, ear cup 112' includes a housing 220 with a cushion 118 secured thereto. Housing 220 includes a divider 520 that at least partially covers various internal components of ear cup 112'. Space, gap, or slot 510 between cushion 118 and divider 520 is configured to receive the pinna of the ear of the user 116.

As demonstrated by various embodiments of the present disclosure, a helmet having integrated ear cups associated with an adjustment or positioning mechanism that is externally operable facilities in-use adjustments to improve ear cup seal and comfort while being worn by the user. Externally positionable ear cups that move between a retracted position and deployed position facilitate donning and doffing the helmet and reduce or eliminate trial and error adjustments that require helmet removal.

While the best mode has been described in detail, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments discussed herein that are described as less desirable than other embodiments or prior art implementations with respect to one or more characteristics are not outside the scope of the disclosure and may be desirable for particular applications.

What is claimed is:

1. A helmet, comprising:

a shell configured to extend over ears of a user and having an aperture;

an ear cup disposed within the shell; and an adjustment mechanism connected to the ear cup, the adjustment mechanism having a base fixed to an interior of the shell and a portion extending through the aperture of the shell to facilitate movement of the ear cup using the portion extending through the shell, wherein the portion extending through the shell comprises a pair of nested threaded posts including a first post coupled to the ear cup to adjust distance between the ear cup and the shell to adjust side pressure and a second post cooperating with a locking nut to selectively clamp the adjustment mechanism to the shell.

2. A helmet, comprising:

a shell configured to extend over ears of a user and having an aperture;

an ear cup disposed within the shell; and an adjustment mechanism connected to the ear cup, the adjustment mechanism having a base fixed to an interior of the shell and a portion extending through the aperture of the shell to facilitate movement of the ear cup using the portion extending through the shell, wherein the adjustment mechanism further comprises:

a positioning member having first and second arms joined at a rearward end and spaced apart at a forward end, the forward end of each arm including an aperture configured to receive a mounting post connected to the ear cup, the first and second arms biased away from one another; and an arch secured to the base and having an opening configured to limit distance between the forward ends of the first and second arms as the positioning member moves through the arch.

3. The helmet of claim 2 further comprising a spring operatively associated with the positioning member to bias the first and second arms away from one another.

4. The helmet of claim 2 wherein the first and second arms comprise a spring material resiliently biased such that the forward ends are spaced apart a distance greater than the arch opening when not constrained by the arch.

5. The helmet of claim 2, the ear cup comprising:

a housing having an exterior portion and an interior divider; and a cushion secured to the housing and spaced from the interior divider to create a slot configured to receive a pinna of a user as the ear cup moves from a rearward retracted position to a forward deployed position.

6. A helmet having a shell configured to cover ears of a user when worn and having an elongated slot on at least one side of the shell, the helmet including an adjustment mechanism comprising:

an arch adapted to be fixedly secured to an interior portion of the shell;

a positioner having first and second arms connected at a proximate end and spaced apart from one another at a distal end, each arm including an aperture adapted to receive an ear cup mounting post; and a clamping device operatively associated with the positioner and having a portion extending through the elongated slot of the shell to move the positioner within the arch and to selectively secure the positioner in a position along the elongated slot of the shell, wherein the clamping device comprises:

a threaded stud extending through the elongated slot and having a knob secured thereto, the knob having a diameter larger than a width of the elongated slot; and a threaded receiver secured to the positioner and configured to cooperate with the threaded stud and knob to selectively secure the positioner along the elongated slot of the shell.

* * * * *